US006171346B1

(12) United States Patent
Yeazell et al.

(10) Patent No.: US 6,171,346 B1
(45) Date of Patent: Jan. 9, 2001

(54) DUAL-STEP STAIN REMOVAL PROCESS

(75) Inventors: Bruce Albert Yeazell; Michael Peter Siklosi, both of Cincinnati, OH (US)

(73) Assignee: The Procter & Gamble Company, Cincinnati, OH (US)

( * ) Notice: Under 35 U.S.C. 154(b), the term of this patent shall be extended for 0 days.

(21) Appl. No.: 09/142,879

(22) PCT Filed: Mar. 18, 1997

(86) PCT No.: PCT/US97/04299

§ 371 Date: Sep. 18, 1998

§ 102(e) Date: Sep. 18, 1998

(87) PCT Pub. No.: WO97/34519

PCT Pub. Date: Sep. 25, 1997

Related U.S. Application Data

(60) Provisional application No. 60/013,760, filed on Mar. 20, 1996.

(51) Int. Cl.[7] ..... D06F 39/02

(52) U.S. Cl. ..... 8/158; 68/235 R; 510/297

(58) Field of Search ..... 68/212, 20, 243, 68/235 R; 8/158, 147; 252/8.6; 510/297

(56) References Cited

U.S. PATENT DOCUMENTS

| | | | |
|---|---|---|---|
| 1,679,843 | 8/1928 | Traube . | |
| 2,132,734 | 10/1938 | Hart et al. | 28/1 |
| 2,552,853 | 5/1951 | Isserstedt | 68/213 |
| 2,810,216 | 10/1957 | Greer | 38/2 |
| 2,987,906 | 6/1961 | Bourland | 68/213 |
| 3,336,616 | 8/1967 | Martin | 15/104 |
| 4,630,312 | 12/1986 | Milstein | 383/86 |
| 5,036,561 | 8/1991 | Calafut | 15/105 |
| 5,238,587 * | 8/1993 | Smith et al. . | |
| 5,687,591 * | 11/1997 | Siklosi et al. . | |
| 5,789,368 * | 8/1998 | You et al. . | |
| 5,804,548 * | 9/1998 | Davis . | |
| 5,840,675 * | 11/1998 | Yeazell . | |
| 5,972,041 * | 10/1999 | Smith et al. . | |

FOREIGN PATENT DOCUMENTS

| | | |
|---|---|---|
| 952471 | 11/1956 | (DE) . |
| 93 20 511 U1 | 11/1994 | (DE) . |
| 769416 | 3/1957 | (GB) . |
| 31312 | 3/1952 | (LU) . |
| WO 97/06723 | 2/1997 | (WO) . |

* cited by examiner

*Primary Examiner*—Frankie L. Stinson
(74) *Attorney, Agent, or Firm*—C. Brant Cook; Kim William Zerby; Steven W. Miller

(57) ABSTRACT

Stained areas (2) of fabric are separately treated with a non-aqueous cleaning composition, followed by an aqueous cleaning composition, and by using a hand-held device (1) which is rocked back and forth on said stained areas (2). The fabric (3) is then placed in a bag or other container, together with a sheet substrate releasably containing an aqueous cleaning composition. The bag is tumbled in a hot air clothes dryer to clean and refresh the entire fabric (3).

9 Claims, 1 Drawing Sheet

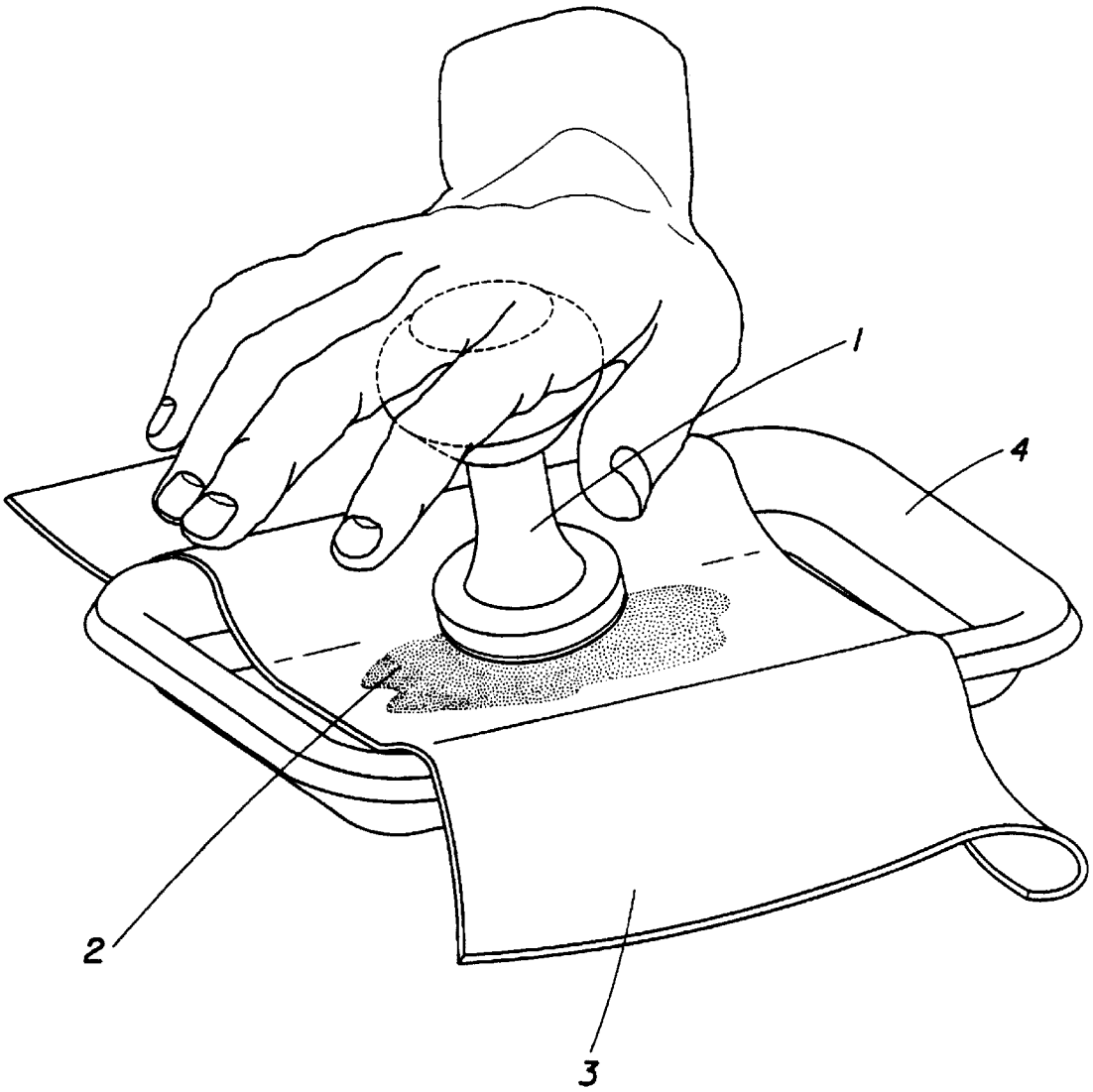
1
2
3
4

DUAL-STEP STAIN REMOVAL PROCESS

CROSS REFERENCE

This application claims priority under Title 35, United States Code 119(e) from Provisional Application Serial No. 60/013,760, filed Mar. 20, 1996.

FIELD OF THE INVENTION

The present invention relates to devices which can be used to remove stains from fabrics. The process is especially useful as part of a dry cleaning operation, but can also be used under any circumstances where spot removal from fabrics is desired.

BACKGROUND OF THE INVENTION

By classical definition, the term "dry cleaning" has been used to describe processes for cleaning textiles using non-aqueous solvents. Dry cleaning is an old art, with solvent cleaning first being recorded in the United Kingdom in the 1860's. Typically, dry cleaning processes are used with garments such as woolens which are subject to shrinkage in aqueous laundering baths, or which are judged to be too valuable or too delicate to subject to aqueous laundering processes. Various hydrocarbon and halocarbon solvents have traditionally been used in immersion dry cleaning processes, and the need to handle and reclaim such solvents has mainly restricted the practice of conventional dry cleaning to commercial establishments.

While solvent-based dry cleaning processes are quite effective for removing oily soils and stains, they are not optimal for removing particulates such as clay soils, and may require special treatment conditions to remove proteinaceous stains. Ideally, particulates and proteinaceous stains are removed from fabrics using detersive ingredients and operating conditions which are more akin to aqueous laundering processes than to conventional dry cleaning.

In addition to the cleaning function, dry cleaning also provides important "refreshment" benefits. For example, dry cleaning removes undesirable odors and extraneous matter such as hair and lint from garments, which are then generally folded or pressed to remove wrinkles and restore their original shape. Of course, such refreshment benefits are also afforded by aqueous laundering processes.

As can be seen from the foregoing, and aside from the effects on certain fabrics such as woolens, there are no special, inherent advantages for solvent-based immersion dry cleaning over aqueous cleaning processes with respect to fabric cleaning or refreshment. Moreover, on a per-garment basis, commercial dry cleaning is much more expensive than aqueous cleaning processes. Accordingly, it would be of considerable benefit to consumers to provide non-immersion dry cleaning processes which can be used in the home.

One type of home dry cleaning system comprises a carrier sheet containing various cleaning agents, and a plastic bag. The garments to be cleaned are placed in the bag together with the sheet, and then tumbled in a conventional clothes dryer. In a commercial embodiment, multiple single-use flat sheets and a single multi-use plastic bag are provided in a package. Unfortunately, such processes may not satisfactorily remove stains from heavily soiled or "spotted" areas of the fabrics being dry cleaned.

As is well known, heavily stained garments may be "pre-spotted" using so-called "spot removal" compositions prior to cleaning. It has now been discovered that the use of water-based spot removal compositions on stained areas of fabrics can yield sub-optimal cleaning performance on some types of stains and fabrics. Conversely, non-aqueous compositions have now been found to be sub-optimal on other stains and fabrics. Moreover, it has also been noted that pre-spotting methods typically involve the vigorous back-and-forth rubbing of the garment with a cleaning composition and a towel, sponge or other implement. It has now further been determined that such rubbing can cause fabric damage and excessive wear.

By the present invention, a dual process is provided which allows the user to pre-spot fabrics using both a non-aqueous and a water-based cleaning composition. In a preferred mode, the process is conducted without resort to rubbing by the use of a device which loosens and removes stains via controlled mechanical action, thereby avoiding fabric damage. As will be seen hereinafter, the device is designed to gently implement Z-axis mechanics only, with respect to the fabric being treated.

BACKGROUND ART

Dry cleaning processes are disclosed in: EP 429,172A1, published May 29, 1991, Leigh, et al.; and in U.S. Pat. No. 5,238,587, issued Aug. 24, 1993, Smith, et al. Other references relating to dry cleaning compositions and processes, as well as wrinkle treatments for fabrics, include: GB 1,598,911; and U.S. Pat. Nos. 4,126,563, 3,949,137, 3,593,544, 3.647,354; 3,432,253 and 1,747,324; and German applications 2,021,561 and 2,460,239, 0,208,989 and 4,007,362. Cleaning/pre-spotting compositions and methods are also disclosed, for example, in U.S. Pat. Nos. 5,102,573; 5,041,230; 4,909,962; 4,115,061; 4,886,615; 4,139,475; 4,849,257; 5,112,358; 4,659,496; 4,806,254; 5,213,624; 4,130,392; and 4,395,261. Sheet substrates for use in a laundry dryer are disclosed in Canadian 1,005,204. U.S. Pat. Nos. 3,956,556 and 4,007,300 relate to perforated sheets for fabric conditioning in a clothes dryer. U.S. Pat. No. 4,692,277 discloses the use of 1,2-octanediol in liquid cleaners. See also U.S. Pat. Nos. 3,591,510; 3,737,387; 3,764,544; 3,882,038; 3,907,496; 4,097,397; 4,102,824; 4,336,024; 4,606,842; 4,758,641; 4,797,310; 4,802,997; 4,943,392; 4,966,724; 4,983,317; 5,004,557; 5,062,973; 5,080,822; 5,173,200; EP 0 213 500; EP0 261 718; G.B. 1,397,475; WO 91/09104; WO 91/13145; WO 93/25654 and Hunt, D. G. and N. H. Morris, "PnB and DPnB Glycol Ethers", *HAPPI*, April 1989, pp. 78–82.

SUMMARY OF THE INVENTION

In the present invention, the user is afforded a selection of cleaning compositions which can be chosen for their ability to remove different types of stains and soils. Thus, a substantially non-aqueous cleaning composition comprising organic solvents can be used to remove oily stains, especially oily stains on rayon acetate or polyester fibers. The user can also employ water-based cleaning compositions, preferably as disclosed hereinafter, to effectively remove particulate soils and stains, i.e., a "dual" cleaning system. In a preferred mode, the process herein is conducted by first using the non-aqueous cleaning composition, followed by use of the aqueous cleaning composition.

The present invention is preferably conducted using a treatment means comprising a spot removal device, especially a device designed for hand-held use, comprising:

(a) a base member having a convex front treatment face and a rear face oppositely disposed from said treatment face;

(b) one or more treatment members extending outwardly from said treatment face; and (c) optionally, a hand grip affixed to said rear face.

A preferred device herein is wherein the front treatment face is substantially hemispherical, or alternatively, inscribes a section of a hemisphere.

In one embodiment of the device, the face has a treatment member which comprises an absorbent material such as a sponge, a pad, or the like. In another embodiment, the treatment member comprises a multiplicity of protrusions, such as bristles. In yet another embodiment of the device, the treatment member comprises a sponge base having a multiplicity of protrusions extending outwardly therefrom.

In other less preferred embodiments, the treatment means need not be part of the device as noted, but can be simple pads, sheets (e.g., disposable paper toweling), cloth wipes, sponges, or the like, which can be pressed against the stained area of the fabric.

The invention also encompasses a method for removing stains from a stained area of fabrics, comprising the steps of:

(a) applying a non-aqueous cleaning composition to said stained area;

(b) concurrently or consecutively with Step (a), contacting the stained area of the fabrics with treatment means, preferably using a convex device as noted above;

(c) applying compressive force to the device, especially using a rocking or rolling motion imparted to the device; and (d) repeating steps (a), (b) and (c) using an aqueous cleaning composition.

Reference is made to the FIGURE. In this preferred mode, the process is conducted using a holding tray or other suitable receptacle as a containment system for the cleaning composition. This allows the mechanical agitation afforded by the device to take place in an environment saturated or partially saturated with cleaning composition, akin to a "micro" washing machine.

The invention also encompasses an overall dry cleaning process for treating an entire area of fabric surface, which comprises a prespotting operation according to this invention and comprising the overall steps of:

(i) conducting a stain removal process according to steps (a)–(d), above on localized stained areas of fabric;

(ii) placing the entire fabric from step (i) together with a carrier containing an aqueous cleaning composition in a containment bag;

(iii) placing the bag in a device to provide agitation, e.g., such as in a hot air clothes dryer and operating the dryer with heat and tumbling; and (iv) removing the fabric from the bag.

While, as noted, the process herein is particularly useful in a stain removal step of a dry cleaning process, it can also be used in a stand-alone stain removal process, or as a stain removal process associated with an otherwise conventional laundering process. Thus, the invention also encompasses an overall laundering process for fabrics which comprises a prespotting operation according to this invention and comprising the overall steps of:

(i) conducting a stain removal process according to steps (a)–(d), above on localized stained areas of the fabric; and (ii) laundering the entire fabric from step (i) in a conventional aqueous laundering process.

The invention also encompasses a dry cleaning kit, comprising:

(a) multiple, single-use sheets containing a non-aqueous dry-cleaning composition;

(b) multiple, single-use sheets containing an aqueous dry-cleaning composition;

(c) a re-usable containment bag;

(d) optionally, a fabric cleaning device, as disclosed herein, and (e) optionally, a re-usable holding tray.

All percentages, ratios and proportions herein are by weight, unless otherwise specified. All documents cited are, in relevant part, incorporated herein by reference.

BRIEF DESCRIPTION OF THE DRAWINGS

The FIGURE is a perspective of the present process using a convex device (1) to spot treat stains (2) using hand pressure. In this procedure, a holding tray (4) is placed beneath the fabric (3) being treated and a sheet substrate releasably containing a cleaning composition is placed in the tray. The fabric being treated is then placed over the sheet substrate and the device is rocked back and forth on the stained area. A portion of the cleaning composition is released from the sheet substrate into and through the stained area of the fabric. The treatment members on the treatment face of the device gently, but effectively, work in combination with the cleaning composition to loosen and remove the stain from the fabric. This same procedure is followed with both the non-aqueous and aqueous cleaning compositions used in the present "dual" process.

DETAILED DESCRIPTION OF THE INVENTION

The components of the devices of this invention and their method of use are described in more detail hereinafter. Such disclosure is by way of illustration and not limitation of the devices and their uses.

By "non-aqueous" cleaning compositions herein is meant compositions which primarily comprise an organic solvent, with little or no water present.

By "aqueous" cleaning compositions herein is meant compositions which comprise a major portion of water, plus cleaning solvents, surfactants, and the like, especially those disclosed hereinafter.

By "protuberances" herein is meant knobs, fibers, bristles or like structures which extend outwardly from the surface of the treatment device. Such elements of the device come into contact with the fabric being spot-cleaned ("prespotted") to provide the mechanical cleaning action.

By "contact with stained areas" is meant contact which is afforded by impingement of the protuberances, pads, sponges, etc., which comprise the treatment means or device with the stained area. It is highly desirable that this contact result in a force which is directed substantially downward, i.e., in the Z-direction substantially perpendicular to the surface of the stain, rather than a side-to-side scrubbing motion in the X- and Y-directions, to minimize fabric damage or "wear". Preferably, the contact is associated with a rocking or rolling motion by the device, whereby the curved surface of the device imparts the force in the Z-direction.

Dry Cleaning Compositions—The chemical compositions which are used to provide the cleaning function in the present device and process comprise ingredients which are safe and effective for their intended use. Since the dry cleaning process herein does not involve an aqueous rinse step, the cleaning compositions employ ingredients which do not leave undesirable residues on fabrics when employed in the manner disclosed herein. While conventional laundry detergents are typically formulated to provide good cleaning on cotton and cotton/polyester blend fabrics, the cleaning compositions herein must be formulated to also safely and effectively clean and refresh fabrics such as wool, silk, rayon, rayon acetate, and the like.

In addition, the cleaning compositions herein comprise ingredients which are specially selected and formulated to minimize dye removal from the fabrics being cleaned. In this regard, it is recognized that the solvents typically used in immersion dry cleaning processes can remove some portion of certain types of dyes from certain types of fabrics. However, such removal is tolerable in immersion processes since the dye is removed relatively uniformly across the surface of the fabric. In contrast, it has now been determined that high concentrations of certain types of cleaning ingredients at specific sites on fabric surfaces can result in unacceptable localized dye removal. The preferred cleaning compositions herein are formulated to minimize or avoid this problem.

The dye removal attributes of the present cleaning compositions can be compared with art-disclosed cleaners using photographic or photometric measurements, or by means of a simple, but effective, visual grading test. Numerical score units can be assigned to assist in visual grading and to allow for statistical treatment of the data, if desired. Thus, in one such test, a colored garment (typically, silk, which tends to be more susceptible to dye loss than most woolen or rayon fabrics) is treated by padding-on cleaner using an absorbent, white paper hand towel. Hand pressure is applied, and the amount of dye which is transferred onto the white towel is assessed visually. Numerical units ranging from: (1) "I think I see a little dye on the towel"; (2) "I know I see some dye on the towel"; (3) I see a lot of dye on the towel"; through (4) "I know I see quite a lot of dye on the towel" are assigned by panelists.

In addition to the foregoing considerations, the cleaning composition used herein is preferably formulated such that it is not so adhesive in nature that it renders the device unhandy or difficult to use. However, and while not intending to be limiting of the present invention, the preferred cleaning compositions disclosed herein afford a spot-cleaning process which is both effective and aesthetically pleasing when used with a device according to this invention.

Having due regard to the foregoing considerations, the following illustrates the ingredients used in the dry cleaning compositions herein, but is not intended to be limiting thereof.

Aqueous Compositions (a) Solvent—The compositions will preferably comprise at least about 4%, typically from about 5% to about 25%, by weight, of solvent. The objective is to provide at least about 0.4 g, preferably from about 0.5 g to about 2.5 g, of solvent per kg of fabrics being cleaned.

(b) Emulsifier—The compositions will comprise sufficient emulsifier to provide a stable, homogeneous composition comprising components (a), (b) and (d). For the preferred emulsifiers disclosed hereinafter, levels as low as 0.05%, preferably 0.07% to about 0.20%, by weight, are quite satisfactory. If less efficient emulsifiers are used, levels up to about 2%, by weight, can be used, but may leave some noticeable residues on the fabrics. Some combinations may require no emulsifier.

(c) Water—The compositions will comprise at least about 60%, typically from about 80% to about 95%, by weight, of water. Stated otherwise, the objective is to provide at least about 6 g of water per kg of fabrics being cleaned.

(d) Optionals—The compositions herein may comprise various optional ingredients, including perfumes, conventional surfactants, and the like. If used, such optional ingredients will typically comprise from about 0.1% to about 10%, by weight, of the compositions, having due regard for residues on the cleaned fabrics.

It has now been determined that 1,2-octanediol ("OD") affords special advantages in the formulation of the cleaning compositions herein. From the standpoint of aesthetics, OD is a relatively innocuous and low odor material. Moreover, OD appears to volatilize from fabric surfaces without leaving visible residues. This is especially important in a dry cleaning process of the present type which is conducted without a rinse step. From the performance standpoint, OD appears to function both as a solvent for greasy/oily stains and as what might be termed a "pseudo-surfactant" for particulate soils and water-soluble stains. Whatever the physical-chemical reason, OD has now been found to be a superior wetting agent with respect to both cleaning and ease-of-use in the present context of home-use cleaning compositions and processes. If used, OD will comprise at least about 0.05%, typically from about 0.1% to about 1.5%, by weight of the cleaning compositions herein.

A preferred solvent herein is butoxy propoxy propanol (BPP) which is available in commercial quantities as a mixture of isomers in about equal amounts. The isomers, and mixtures thereof, are useful herein. The isomer structures are as follows:

$$n\text{—}C_4H_9\text{—}O\text{—}CH_2CH_2CH_2\text{—}O\text{—}CH_2CH_2CH_2\text{—}OH$$

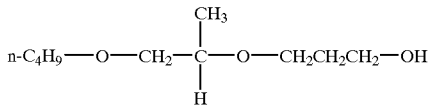

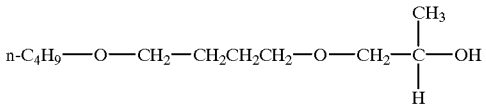

BPP is outstanding for cleaning, and is so effective that it allows the amount of the relatively expensive 1,2-octanediol to be minimized. Moreover, it allows for the formulation of effective cleaning compositions herein without the use of conventional surfactants. Importantly, the odor of BPP is of a degree and character that it can be relatively easily masked by conventional perfume ingredients. While BPP is not completely miscible with water and, hence, could negatively impact processing of the cleaning compositions herein, that potential problem has been successfully overcome by means of the PEMULEN-type polyacrylate emulsifiers, as disclosed hereinafter.

The BPP solvent used herein is preferably a mixture of the aforesaid isomers. In a preferred mode, the cleaning compositions comprise a mixture of the 1,2-octanediol and BPP, at a weight ratio of OD:BPP in the range of from about 1:250 to about 2:1, preferably from about 1:200 to about 1:5.

A highly preferred emulsifier herein is commercially available under the trademark PEMULEN, The B. F. Goodrich Company, and is described in U.S. Pat. Nos. 4,758,641 and 5,004,557, incorporated herein by reference. PEMULEN polymeric emulsifiers are high molecular weight polyacrylic acid polymers. The structure of PEMULEN includes a small portion that is oil-loving (lipophilic) and a large water-loving (hydrophilic) portion. The structure allows PEMULEN to function as a primary oil-in-water emulsifier. The lipophilic portion adsorbs at the oil-water interface, and the hydrophilic portion swells in the water forming a network around the oil droplets to provide emulsion stability. An important advantage for the use of such polyacrylate emulsifiers herein is that cleaning compositions can be prepared which contain solvents or levels of solvents that are otherwise not soluble or readily miscible with water. A further advantage is that effective emulsification can be accomplished using PEMULEN-type emulsifier at extremely low usage levels (0.05–0.2%), thereby minimizing the level of any residue left on fabrics following product usage. For comparison, typically about 3–7% of conventional anionic or nonionic surfactants are required to stabilize oil-in-water emulsions, which increases the likelihood that a residue will be left on the fabrics. Another advantage is that emulsification (processing) can be accomplished effectively at room temperature.

While the cleaning compositions herein function quite well with only the 1,2-octanediol, BPP, PEMULEN and water, they may also optionally contain detersive surfactants to further enhance their cleaning performance. While a wide variety of detersive surfactants such as the $C_{12}$–$C_{16}$ alkyl sulfates and alkylbenzene sulfonates, the $C_{12}$–$C_{16}$ ethoxylated (EO 0.5–10 avg.) alcohols, the $C_{12}$–$C_{14}$ N-methyl glucamides, and the like can be used herein, it is highly preferred to use surfactants which provide high grease/oil removal. Included among such preferred surfactants are the $C_{12}$–$C_{16}$ alkyl ethoxy sulfates (AES), especially in their magnesium salt form, and the $C_{12}$–$C_{16}$ dimethyl amine oxides. Especially preferred mixtures comprise $MgAE_1S$/$MgAE_{6.5}S$/$C_{12}$ dimethyl amine oxide, at a weight ratio of about 1:1:1, and $MgAE_1S$/$C_{12}$ dimethyl amine oxide at a 2:1 weight ratio. If used, such surfactants will typically comprise from about 0.05% to about 2.5%, by weight, of the cleaning compositions herein.

In addition to the preferred solvents and emulsifiers disclosed above, the cleaning compositions herein may comprise various optional ingredients, such as perfumes, preservatives, co-solvents, brighteners, salts for viscosity control, pH adjusters or buffers, anti-static agents such as VERSAFLEX 157 or VERSAFLEX 2004 from National Starch and Chemical Company, softeners, colorants, mothproofing agents, insect repellents, and the like. Enzymes such as proteases, amylases, lipases and mixtures thereof can also be used at levels from about 0.0001% to about 1% of the compositions. The following illustrates preferred ranges for cleaning compositions for use herein, but is not intended to be limiting thereof.

| Ingredient | % (wt.) Formula Range |
|---|---|
| BPP* | 5–25% |
| 1,2-Octanediol | 0.1–7% |
| PEMULEN** | 0.05–0.20% |
| Neodol 23–6.5*** | 0.1–2.5% |
| Perfume | 0.01–1.5% |
| Water | Balance |
| pH range from about 6 to about 8. | |

-continued

| Ingredient | % (wt.) Formula Range |
|---|---|

*Other solvents or co-solvents which can be used herein include various glycol ethers, including materials marketed under trademarks such as Carbitol, methyl Carbitol, butyl Carbitol, propyl Carbitol, and hexyl Cellosolve, and especially methoxy propoxy propanol (MPP), ethoxy propoxy propanol (EPP), propoxy propoxy propanol (PPP), and all isomers and mixtures, respectively, of MPP, EPP, and PPP, and the like, and mixtures thereof.

Indeed, although somewhat less preferred, the MPP, EPP and PPP, respectively, can replace the BPP solvent in the foregoing cleaning compositions. The levels of these solvents, and their ratios with 1,2-octanediol, are the same as with the preferred BPP solvent.

If desired, and having due regard for safety and odor for in-home use, various conventional chlorinated and hydrocarbon dry cleaning solvents may also be used. Included among these are 1,2-dichloroethane, trichloroethylene, isoparaffins, and mixtures thereof.

**As disclosed in U.S. Pat. Nos. 4,758,641 and 5,004,557, such polyacrylates include homopolymers which may be crosslinked to varying degrees, as well as non-crosslinked. Preferred herein are homopolymers having a molecular weight in the range of from about 100,000 to about 10,000,000, preferably 200,000 to 5,000,000.

***$C_{12}$–$C_{13}$ alcohol average ethoxylate (EO) 6.5; trademark Shell.

Non-aqueous Compositions—The non-aqueous cleaning compositions used herein can comprise any of the foregoing organic solvents and mixtures thereof, or other organic solvents which are known for use in spot removal and/or dry cleaning processes. A preferred non-aqueous cleaning composition comprises BPP and mixtures of BPP and butoxy propanol (BP) at a weight ratio of BPP:BP in the range from about 10:1 to about 1:10, most preferably 9 BPP:1 BP. The non-aqueous cleaning compositions herein are formulated without the use of water. While some water may be introduced into the non-aqueous compositions, this will mainly occur as a result of trace contamination of the organic solvents. In general, the non-aqueous cleaning compositions herein will be "substantially free" of water, i.e., will contain less than about 5%, preferably less than about 1%, most preferably 0%, by weight, of water.

Carrier—When used in a dry cleaning operation of the present type, the foregoing cleaning compositions are preferably used in combination with a carrier, such that the cleaning composition performs its function as the surfaces of the fabrics being cleaned come in contact with the surface of the carrier. The carrier releasably contains the cleaning composition. By "releasably contains" means that the cleaning composition is effectively released from the carrier onto the soiled fabrics as part of the spot removal and dry cleaning processes herein.

The carrier can be in any desired form, such as powders, flakes, shreds, and the like. However, it will be appreciated that such commuted carriers would have to be separated from the fabrics at the end of the cleaning process. Accordingly, it is highly preferred that the carrier be in the form of an integral pad or sheet which substantially maintains its structural integrity throughout the cleaning process. Such pads or sheets can be prepared, for example, using well-known methods for manufacturing non-woven sheets, paper towels, fibrous batts, cores for bandages, diapers and catamenials, and the like, using materials such as wood pulp, cotton, rayon, polyester fibers, and mixtures thereof. Woven cloth pads may also be used, but are not preferred over non-woven pads due to cost considerations. Integral carrier pads or sheets may also be prepared from natural or synthetic sponges, foams, and the like.

The carriers are designed to be safe and effective under the intended operating conditions of the present process. The carriers must not be flammable during the process, nor should they deleteriously interact with the cleaning composition or with the fabrics being cleaned. In general, non-woven polyester-based pads or sheets are quite suitable for use as the carrier herein.

The carrier used herein is most preferably non-linting. By "non-linting" herein is meant a carrier which resists the shedding of visible fibers or microfibers onto the fabrics being cleaned, i.e., the deposition of what is known in common parlance as "lint". A carrier can easily and adequately be judged for its acceptability with respect to its non-linting qualities by rubbing it on a piece of dark blue woolen cloth and visually inspecting the cloth for lint residues.

The non-linting qualities of sheet or pad carriers used herein can be achieved by several means, including but not limited to: preparing the carrier from a single strand of fiber; employing known bonding techniques commonly used with nonwoven materials, e.g., point bonding, print bonding, adhesive/resin saturation bonding, adhesive/resin spray bonding, stitch bonding and bonding with binder fibers. In an alternate mode, a carrier can be prepared using an absorbent core, said core being made from a material which, itself, sheds lint. The core is then enveloped within a sheet of porous, non-linting material having a pore size which allows passage of the cleaning compositions, but through which lint from the core cannot pass. An example of such a carrier comprises a cellulose or polyester fiber core enveloped in a non-woven polyester scrim.

The carrier should be of a size which provides sufficient surface area that effective contact between the surface of the carrier and the surface of the fabrics being cleaned is achieved. Of course, the size of the carrier should not be so large as to be unhandy for the user. Typically, the dimensions of the carrier will be sufficient to provide a macroscopic surface area (both sides of the carrier) of at least about 360 $cm^2$, preferably in the range from about 360 $cm^2$ to about 3000 $cm^2$. For example, a rectangular carrier may have the dimensions (X-direction) of from about 20 cm to about 35 cm, and (Y-direction) of from about 18 cm to about 45 cm.

The carrier is intended to contain a sufficient amount of the cleaning composition to be effective for its intended purpose. The capacity of the carrier for the cleaning composition will vary according to the intended usage. For example, carrier/cleaning composition pads or sheets which are intended for a single use will require less capacity than such pads or sheets which are intended for multiple uses. For a given type of carrier the capacity for the cleaning composition will vary mainly with the thickness or "caliper" (Z-direction; dry basis) of the sheet or pad. For purposes of illustration, typical single-use polyester sheets used herein will have a thickness in the range from about 0.1 mm to about 0.7 mm and a basis weight in the range from about 30 $g/m^2$ to about 100 $g/m^2$. Typical multi-use polyester pads herein will have a thickness in the range from about 0.2 mm to about 1.0 mm and a basis weight in the range from about 40 $g/m^2$ to about 150 $g/m^2$. Open-cell sponge sheets will range in thickness from about 0.1 mm to about 1.0 mm. Of course, the foregoing dimensions may vary, as long as the desired quantity of the cleaning composition is effectively provided by means of the carrier.

A preferred carrier herein comprises a binderless (or optional low binder), hydroentangled absorbent material, especially a material which is formulated from a blend of cellulosic, rayon, polyester and optional bicomponent fibers. Such materials are available from Dexter, Non-Wovens Division, The Dexter Corporation as HYDRASPUN®, especially Grade 10244. The manufacture of such materials forms no part of this invention and is already disclosed in the literature. See, for example, U.S. Pat. No. 5,009,747, Viazmensky, et al., Apr. 23, 1991 and U.S. Pat. No. 5,292,581, Viazmensky, et al., Mar. 8, 1994, incorporated herein by reference. Preferred materials for use herein have the following physical properties.

| | Grade 10244 | Targets | Optional Range |
|---|---|---|---|
| Basis Weight | $gm/m^2$ | 55 | 35–75 |
| Thickness | microns | 355 | 100–1500 |
| Density | | gm/cc | 0.155 0.1–0.25 |
| Dry Tensile | gm/25 mm | | |
| MD | | 1700 | 400–2500 |
| CD | | 650 | 100–500 |
| Wet Tensile | gm/25 mm | | |
| MD* | | 700 | 200–1250 |
| CD* | | 300 | 100–500 |
| Brightness | % | 80 | 60–90 |
| Absorption Capacity | % | 735 | 400–900 ($H_2O$) |
| Dry Mullen | $gm/cm^2$ | 1050 | 700–1200 |

*MD - machine direction; CD - cross direction

As disclosed in U.S. Pat. Nos. 5,009,747 and 5,292,281, the hydroentangling process provides a nonwoven material which comprises cellulosic fibers, and preferably at least about 5% by weight of synthetic fibers, and requires less than 2% wet strength agent to achieve improved wet strength and wet toughness.

Surprisingly, this hydroentangled carrier is not merely a passive absorbent for the cleaning compositions herein, but actually optimizes cleaning performance. While not intending to be limited by theory, it may be speculated that this carrier is more effective in delivering the cleaning composition to soiled fabrics. Or, this particular carrier might be better for removing soils by contact with the soiled fabrics, due to its mixture of fibers. Whatever the reason, improved dry cleaning performance is secured.

In addition to the improved cleaning performance, it has now been discovered that this hydroentangled carrier material provides an additional, unexpected benefit due to its resiliency. In-use, the dry cleaning sheets herein are designed to function in a substantially open configuration. However, the sheets are packaged and sold to the consumer in a folded configuration. It has been discovered that carrier sheets made from conventional materials tend to undesirably revert to their folded configuration in-use. This undesirable attribute can be overcome by perforating such sheet, but this requires an additional processing step. It has now been discovered that the hydroentangled materials used to form the carrier sheet herein do not tend to re-fold during use, and thus do not require such perforations (although, of course, perforations may be used if desired). Accordingly, this newly-discovered and unexpected attribute of the carrier materials herein makes them optimal for use in the manner of the present invention.

Controlled Release Carriers—Other carriers which can be used in the present invention are characterized by their ability to absorb liquid cleaning compositions, and to release them in a controlled manner. Such carriers can be single-layered or multi-layer laminates. In one embodiment, such controlled-release carriers can comprise the absorbent core materials disclosed in U.S. Pat. No. 5,009,653, issued Apr. 23, 1991, to T. W. Osborn III, entitled "Thin, Flexible Sanitary Napkin", assigned to The Procter & Gamble Company, incorporated herein by reference. Another specific example of a controlled-release carrier herein comprises a hydroentangled web of fibers (as disclosed above)

having particles of polymeric gelling materials dispersed, either uniformly or non-uniformly, in the web. Suitable gelling materials include those disclosed in detail at columns 5 and 6 of Osborn, as well as those disclosed in U.S. Pat. No. 4,654,039, issued Mar. 31, 1987, to Brandt, Goldman and Inglin. Other carriers useful herein include WATER-LOCK® L-535, available from the Grain Processing Corporation of Muscatin, Iowa. Non-particulate superabsorbents such as the acrylate fibrous material available under the tradename LANSEAL F from the Choli Company of Higashi, Osaka Japan and the carboxymethylcellulose fibrous material available under the tradename AQUALON C from Hercules, Inc., of Wilmington, Del. can also be used herein. These fibrous superabsorbents are also convenient for use in a hydro-entangled-type web.

In another embodiment the controlled release carrier can comprise absorbent batts of cellulosic fibers or multiple layers of hydroentangled fibers, such as the HYDRASPUN sheets noted above. In this embodiment, usually 2 to about 5 sheets of HYDRASPUN, which can optionally be spot-bonded or spot-glued to provide a coherent multi-layered structure, provides an absorbent carrier for use herein without the need for absorbent gelling materials, although such gelling materials can be used, if desired. Other useful controlled release carriers include natural or synthetic sponges, especially open-cell polyurethane sponges and/or foams. Whatever controlled release carrier is selected, it should be one which imbibes the liquid cleaning compositions herein thoroughly, yet releases them with the application of pressure or heat. Typically, the controlled release carriers herein will feel wet or, preferably, somewhat damp-to-nearly dry to the touch, and will not be dripping wet when carrying 10–30 g. of the cleaning composition.

Coversheet—In an optional embodiment, a liquid permeable coversheet is superimposed over the carrier. In one embodiment, the coversheet is associated with the carrier by spray-gluing the coversheet to the surface of the carrier. The coversheet is preferably a material which is compliant and soft feeling. Further, the coversheet is liquid and/or vapor pervious, permitting the cleaning composition to transfer through its thickness. A suitable coversheet may be manufactured from a wide range of materials such as polymeric materials, formed thermoplastic films, apertured plastic films, porous films, reticulated foams, natural fibers (e.g., wood or cotton fibers), woven and non-woven synthetic fibers (e.g., polyester or polypropylene fibers) or from a combination of natural and synthetic fibers, with apertured formed films being preferred. Apertured formed films are preferred for the coversheet because they are pervious to the liquid cleaning composition (or vapors) and yet non-absorbent. Thus, the surface of the formed film which is in contact with the fabrics remains relatively dry, thereby reducing water spotting and dye transfer. Suitable formed films are described in U.S. Pat. No. 3,929,135, entitled "Absorptive Structure Having Tapered Capillaries", issued to Thompson on Dec. 30, 1975; U.S. Pat. No. 4,324,246, entitled "Disposable Absorbent Article Having A Stain Resistant Coversheet", issued to Mullane and Smith on Apr. 13, 1982; U.S. Pat. No. 4,342,314, entitled "Resilient Plastic Web Exhibiting Fiber-Like Properties", issued to Radel and Thompson on Aug. 3, 1982; and U.S. Pat. No. 4,463,045, entitled "Macroscopically Expanded Three-Dimensional Plastic Web Exhibiting Non-Glossy Visible Surface and Cloth-Like Tactile Impression", issued to Ahr, Louis, Mullane and Ouellete on Jul. 31, 1984, all of which are incorporated herein by reference.

In a preferred embodiment of the present invention, the outer and/or inner surfaces of the coversheet are hydrophilic. The surfaces of the coversheet can be made hydrophilic by treatment with a surfactant which is substantially evenly and completely distributed throughout the surface of the coversheet. This can be accomplished by any of the common techniques well known to those skilled in the art. For example, the surfactant can be applied to the coversheet by spraying, by padding, or by the use of transfer rolls. Further, the surfactant can be incorporated into the polymeric materials of a formed film coversheet. Such methods are disclosed in U.S. Pat. No. 5,009,653, cited above.

Spot Removal Devices—The devices herein can be manufactured by injection molding using polymers such as low- and high-density polyethylene, polypropylene, nylon-6, nylon-6,6, acrylics, acetals, polystyrene, polyvinyl chloride, and the like. High density polyethylene and polypropylene are within this range and are preferred for use herein.

The treatment members on the devices herein can comprise natural or synthetic bristles, natural or synthetic sponges, absorbent pads such as cotton, rayon, regenerated cellulose, and the like, as well as the HYDRASPUN® fabric described hereinabove. Various useful materials are all well-known in the cleaning arts in conventional brushes and toothbrushes (see U.S. Pat. No. 4,637,660) and in various cleaning utensils. Sponges, pads, and the like will typically have a thickness of from about 1 mm to about 1.25 cm and can be glued to the convex front treatment face of the device. Preferably, the sponges, pads, bristled pads, etc., are typically co-extensive with substantially the entire treatment face.

The protuberances herein can be in the form of blunt or rounded bristles, which may be provided uniformly across the entire treatment face or in clusters. The protuberances can be in the form of monofilament loops, which can be circular, ovoid or elongated, or can be cut loops. The protuberances can comprise twisted fiber bundles, extruded nubs, molded finger-like appendages, animal hair, reticulated foams, rugosities molded into the face of the member, and the like. Protuberances made from monofilament fibers may be straight, twisted or kinked.

In one embodiment, the treatment member can comprise multiple components. In particular, the treatment member can comprise an absorbent base material which can be, for example, a natural or synthetic sponge, an absorbent cellulosic sheet or pad, or the like. In contact with and extending outward from this base material are multiple protrusions as disclosed above. A specific example of this embodiment is a treatment member comprising multiple looped protuberances made from monofilament fibers which protrude from a sponge base layer. In this embodiment, the absorbent base layer acts as a reservoir which feeds cleaning composition to the protuberances.

In various optional modes, the treatment members present on the convex face of the device herein can comprise a multi-layer composite comprising a sponge-like, resilient backing material for a fibrous layer having multiple fibrous elements extending outwardly therefrom. Such composites can be permanently or semi-permanently affixed to the treatment members using glue or other conventional means, and, typically, are substantially co-extensive with the face of the treatment member. Such composites can be made from conventional materials, e.g., using a sponge, foam or other absorbent base pad material from about 0.5–20 mm thickness and a layer of fibers such as a conventional painter's pad with fibers having a length of from about 0.05 mm to about 20 mm.

The protuberances herein are typically provided as a bed or mat which comprises multiple strands or loops which extend therefrom in the Z-direction. Convenient and familiar sources include pile carpet-type materials, paint pad-type materials, and the like. In such embodiments, the treatment member will comprise several thousand protuberances per $cm^2$. With the preferred looped protuberances herein, there will typically be 10–500, preferably about 60–150, loops per $cm^2$. The choice of the source, style and number of protuberances are matters for the manufacturer's discretion, and the foregoing illustrations are not intended to be limiting of the invention.

The protuberances should preferably extend outwardly from the face of the treatment member for a distance of at least about 0.2 mm. While there is no upper limit to their length, there is essentially no functional reason for the protuberances to extend more than about 1.25 cm.

The protuberances can be made from plastic, rubber or any other convenient, resilient material which is stable in the presence of the cleaning composition. Fibrous protrusions can be made from natural or synthetic fibers. Fiber diameters can typically range from 0.1 mil (0.0025 mm) to 20 mil (0.5 mm). Again, this is a matter of selection and is not intended to be limiting.

In one embodiment, the protuberances are in the form of a multiplicity of stiffened, ovoid looped fibers which extend outwardly from the treatment face. Such looped fibers can comprise, for example, 7 mil (0.18 mm) monofilament loops of polypropylene extending at least about 0.03 inch (0.76 mm), typically from about 2.0 mm to about 1.5 cm, outwardly from the face of a backing material. The diameter of the loops at their widest point is about 1.3 mm. A convenient material for said looped protrusions is available commercially from APLIX Inc., Number 200, Unshaved Loop, Part No. DM32M000-QY. This material comprises a nylon backing with about 420 loops per square inch (65 loops per $cm^2$) extending from its surface.

It will be appreciated that the devices herein can be made from a variety of plastic, glass, wood, etc. materials and with various overall shapes, decorations and the like, according to the desires of the manufacturer. Of course, the devices are preferably made from materials which will not be affected by the various ingredients used in the cleaning compositions. The size of the devices is entirely optional. It is contemplated that rather large devices (e.g. 200–1000 $cm^2$ convex treatment face) would be suitable for mounting and use in a commercial cleaning establishment. For in-home use, the device is intended for hand-held use, and its dimensions are generally somewhat smaller; typically, the surface area of the convex treatment face for home use will be in the range of from about 10 $cm^2$ to about 200 $cm^2$. While the convex treatment faces illustrated herein are, mainly, sections of spheres, the convex face of the device can also be in the manner of a desk-style ink blotter. Stated otherwise, the front treatment face of the device can be outwardly curved over its operational plane, but flat along its sides.

While the surface area of the treatment members can be adjusted according to the desires of the manufacturer, it is convenient for a hand-held, home-use device to have a treatment face whose surface area is in the range from about 25 $cm^2$ to about 70 $cm^2$.

Stain Removal and Wet Cleaning Process—The dual pre-spotting process herein can be used in a spot removal pre-treatment step of a conventional laundering process. Thus, the stained area is first treated in the manner herein until the stain is loosened or substantially removed. The entire fabric can then be laundered in an aqueous bath, in the conventional manner.

Suitable detergent compositions for use in the laundering step of a wet cleaning process typically comprise one or more detersive surfactants such as the $C_{12}$–$C_{14}$ alkyl benzene sulfonates, $C_{10}$–$C_{18}$ alkyl sulfates, $C_{10}$–$C_{18}$ ethoxylated alcohols, $C_{10}$–$C_{18}$ alkylethoxy sulfates, $C_{12}$–$C_{18}$ polyhydroxy fatty acid amides, and the like. Such compositions may also comprise builders, such as zeolites, phosphates, citrate, and the like. Other ingredients such as detersive enzymes, percarbonate or perborate bleaches, bleach activators, and the like, may also be present. Commercial examples of detergents are well-known. Further examples are disclosed in U.S. Pat. No. 5,451,341 to White, issued Sep. 19, 1995 and in U.S. Pat. Nos. 5,288,431; 4,968,451; 4,597,898 and 4,515,705.

Stain Removal and Dry Cleaning Process—While the dual process of the present invention can be employed under any circumstances where stain removal from a fabric is desired, such as a spot removal step in a conventional aqueous laundering process as noted above, it is especially useful in a home dry cleaning process, as is described in more detail hereinafter.

As shown in the FIGURE, the device and non-aqueous cleaning composition on a carrier are first brought into close contact with the stain, e.g., by rocking or rolling the device on the stain, typically using hand pressure. Side-to-side rubbing with the device is preferably avoided to minimize potential fiber damage. Contact is maintained for a period of 1–10 seconds for lighter stains and 1–5 minutes, or longer, for heavier or more persistent stains. This process is then repeated using the aqueous cleaning composition. After the stains are loosened in the described manner, the loosened stain matter and excess cleaning composition are preferably removed by gentle padding with a towel or tissue.

The second step of the overall process is conducted in a tumbling apparatus, preferably in the presence of heat. In a convenient mode a nylon container bag with the carrier/aqueous cleaning composition and enveloping the pre-spotted fabric to be dry cleaned is sealed and placed in the drum of an automatic hot air clothes dryer at temperatures of 40° C.–150° C. The drum is allowed to revolve, which imparts a tumbling action to the bag and agitation of its contents concurrently with the tumbling. By virtue of this agitation, the fabrics come in contact with the carrier containing the cleaning composition. The tumbling and heating are carried out for a period of at least about 10 minutes, typically from about 20 minutes to about 30 minutes. This step can be conducted for longer or shorter periods, depending on such factors as the degree and type of soiling of the fabrics, the nature of the soils, the nature of the fabrics, the fabric load, the amount of heat applied, and the like, according to the needs of the user.

The following examples illustrate the present invention in more detail, but are not intended to be limiting thereof.

EXAMPLE I

A dry cleaning article in sheet form is assembled using a sheet substrate and an aqueous cleaning composition prepared by admixing the following ingredients.

| Ingredient | % (wt.) |
|---|---|
| BPP* | 7.0 |
| 1,2-octanediol | 0.5 |
| PEMULEN TR-1** | 0.125 |

-continued

| Ingredient | % (wt.) |
|---|---|
| KOH | 0.08 |
| $C_{12}$–$C_{13}$ EO (6.5) | 1.0 |
| Perfume | 0.75 |
| Water and minors*** | Balance |

*Isomer mixture, available from Dow Chemical Co.
**PEMULEN TR-2, B. F. Goodrich, may be substituted.
***Includes preservatives such as KATHON ®.

A non-linting carrier sheet is prepared using stock HYDRASPUN® Grade 10244 fabric, described above. The fabric is cut into square carrier sheets, approximately 9 in (22.9 cm)×10 in (25.4 cm), i.e., 580.6 $cm^2$ sheets.

10–30 Grams of the above-noted cleaning composition are evenly applied to the sheet by spreading onto the sheet with a roller or spatula using hand pressure. In an alternate mode, the cleaning composition can be applied by dipping or spraying the composition onto the substrate, followed by squeezing with a roller or pair of nip rollers, i.e., by "dip-squeezing" or "spray squeezing". The external surfaces of the sheet are damp but not tacky to the touch. The finished sheet can be folded for packaging, and when unfolded and used in the manner disclosed herein, the sheet remains in the desired unfolded configuration.

Other useful aqueous compositions which can be used in like manner are as follows:

| INGREDIENT | PERCENT (wt.) | (RANGE) |
|---|---|---|
| Butoxypropoxy propanol (BPP) | 7.000 | 4.0–25.0% |
| NEODOL 23–6.5* | 0.750 | 0.05–2.5% |
| 1,2-Octanediol | 0.500 | 0.1–10.0% |
| Perfume | 0.750 | 0.1–2.0% |
| Pemulen TR-1 | 0.125 | 0.05–0.2% |
| Potassium Hydroxide (KOH) | 0.060 | 0.024–0.10 |
| Potassium Chloride | 0.075 | 0.02–0.20 |
| Water (distilled or deionized) | 90.740 | 60.0–95.0% |
| Target pH = 7.0 | | |

*Shell; $C_{12}$–$C_{13}$ alcohol, ethoxylated with average EO of 6.5.

Besides the optional nonionic surfactants in the cleaning compositions herein, which are preferably $C_8$–$C_{18}$ ethoxylated (E01-15) alcohols or the corresponding ethoxylated alkyl phenols, the compositions can contain enzymes to further enhance cleaning performance. Lipases, amylases and protease enzymes, or mixtures thereof, can be used. If used, such enzymes will typically comprise from about 0.001% to about 5%, preferably from about 0.01% to about 1%, by weight, of the composition. Commercial detersive enzymes such as LIPOLASE, ESPERASE, ALCALASE, SAVINASE and TERMAMYL (all ex. NOVO) and MAXATASE and RAPIDASE (ex. International Bio-Synthesis, Inc.) can be used.

If an antistatic benefit is desired, the compositions used herein can contain an anti-static agent. If used, such anti-static agents will typically comprise at least about 0.5%, typically from about 2% to about 8%, by weight, of the compositions. Preferred anti-stats include the series of sulfonated polymers available as VERSAFLEX 157, 207, 1001, 2004 and 7000, from National Starch and Chemical Company.

The compositions herein can optionally be stabilized for storage using conventional preservatives such as KATHON® at a level of 0.0001%–1%, by weight.

A sheet of HYDRASPUN fabric, as described above, comprising 10–30 grams of a mixture comprising 9 parts BPP solvent and 1 part BP solvent, with no added water, is prepared separately.

A stained area on a fabric is treated in a dual pre-spotting step using the non-aqueous and aqueous compositions in the manner disclosed above.

Preferably, both steps are conducted using a tray device as depicted in the FIGURE. The sheets can be marked, color-coded, or the like, to instruct the user regarding which sheet should be used first, and which should be used second. After the localized stains are substantially removed in this manner, the fabrics can be further cleaned in an automatic clothes dryer in the manner described hereinafter.

The pre-spotted fabric and sheet article are then placed in a flexible bag (most preferably prepared from 1–3 mil nylon film) together with the sheet containing the aqueous cleaning composition. The bag is closed and sealed using a Velcro®-type fastener. Other fasteners such as nylon zipper and Zip-Lok®-type fasteners may also be used. In a typical mode, the bag will have a volume of about 25,000 $cm^3$, which will accommodate up to about 2 kg of dry fabrics. When the fabrics and the dry cleaning sheet are placed in the bag, the air is preferably not squeezed out of the bag before closing and sealing. This allows the bag to billow, thereby providing sufficient space for the fabrics and cleaning sheet to tumble freely together. The bag is then closed, sealed and placed in a conventional hot-air clothes dryer. The dryer is started and the bag is tumbled for a period of 20–30 minutes at a dryer air temperature in the range from about 40° C. to about 150° C. During this time, the sheet comes into close contact with the fabrics. After the machine cycle is complete, the bag and its contents are removed from the dryer, and the spent dry cleaning sheet is discarded. The nylon bag is retained for re-use. The fabrics are cleaned and refreshed. The water present in the cleaning composition serves to minimize wrinkles in the fabrics. Excellent overall cleaning is secured when from about 3 g to about 50 g of the preferred cleaning compositions herein are used per kilogram of fabric being cleaned.

EXAMPLE II

The following illustrates a typical dry cleaning kit herein, but is not intended to be limiting thereof.

A dry cleaning kit is assembled packaging a re-usable pre-spotting device as disclosed herein, multiple (typically, 5–10) single use dry cleaning articles comprising sheets releasably containing the non-aqueous cleaning composition and, separately, multiple (typically 5–10) sheets releasably containing the aqueous cleaning composition, all of the type described herein, together with a sealable, reusable heat-resistant container bag, in a package comprising a conventional cardboard box suitable for retail sales. In an alternate mode, the articles may be in the form of spheres or polyhedra. In yet another mode, a reusable holding tray is provided in the kit for use as illustrated in the FIGURE.

EXAMPLE III

A sheet of HYDRASPUN fabric as described in Example I containing about 17 grams of a 9:1 mixture of BPP:BP is placed in a tray as shown in the FIGURE. In a first step, a stained area of fabric is placed flat and in contact with the sheet. The device herein is placed in contact with the fabric and rocked back-and-forth, using hand pressure, until the stain is substantially removed. Side-to-side rubbing is avoided.

In a second step, the stained area of the fabric is placed over a sheet containing a water-based cleaning composition (as described above) and the treatment with the device herein is repeated.

After the stains are substantially removed, the fabric is placed together with a sheet containing an aqueous cleaning composition (again, as noted in any of the foregoing Examples), placed in a containment bag, and tumbled in a hot air clothes dryer.

In this mode, the containment bag is provided with a series of holes or vents to provide controlled release of vapors in the hot air clothes dryer, thereby minimizing wrinkling. Typically, 6 pairs of 2 mm diameter venting holes are punched in a 25000 $cm^3$ nylon bag and used herein. The amount of venting can be varied, e.g., from 6 pairs of 2 mm holes for 1× (23 g) usage of the water-based cleaning composition up to 15 pairs of 6 mm holes for 3× composition usage.

In an alternate mode, the first pre-spotting step of the process herein is conducted using a conventional, commercial, spot removal composition. Such compositions are available as sticks, gels, sprays and the like. Thus, a conventional non-aqueous spot remover is placed on the stained area of the fabric and gently worked into the stain by the rocking action of the device herein. The fabric is then further treated in the manner disclosed above.

EXAMPLE IV

In an alternate mode, the HYDRASPUN fabric used in any of the foregoing Examples is replaced by an absorbent pad structure as described hereinabove as a "Controlled Release Carrier". Optionally, but preferably, the resulting pad is covered with an apertured formed-film coversheet, also as disclosed above. The resulting articles comprising, separately, the non-aqueous and aqueous cleaning compositions, are used in the manner disclosed herein to clean fabrics.

What is claimed is:

1. A method for removing stains from a stained area of fabrics, comprising the steps of:

(a) applying a non-aqueous cleaning composition to said stained area;

(b) concurrently or consecutively with Step (a), contacting the stained area of the fabrics with treatment means;

(c) applying compressive force to the treatment means; and (d) repeating steps (a), (b) and (c) using an aqueous cleaning composition.

2. A method according to claim 1 wherein said treatment means are affixed to the convex treatment face of a hand-held device.

3. A method according to claim 2 wherein the compressive force is applied using a rocking or rolling motion imparted to the device.

4. A method according to claim 1 wherein the non-aqueous cleaning composition comprises a mixture of butoxy propoxy propanol and butoxy propanol.

5. A method according to claim 1 wherein the aqueous cleaning composition comprises water, butoxy propoxy propanol and 1,2-octanediol.

6. An overall dry cleaning process for treating an entire area of fabric surface, which comprises a prespotting operation according to claim 1 and comprising the overall steps of:

(i) conducting a stain removal process according to steps (a)–(d) of claim 1, on localized stained areas of fabric;

(ii) placing the entire fabric from step (i) together with a carrier containing an aqueous cleaning composition in a containment bag;

(iii) placing the bag in a device to provide agitation and agitating said bag; and (iv) removing the fabric from the bag.

7. A process according to claim 6 wherein step (iii) is conducted in a hot air clothes dryer.

8. An overall laundering process for fabrics which comprises a prespotting operation according to claim 1, and comprising the overall steps of:

(i) conducting a stain removal process according to steps (a)–(d) of claim 1 on localized stained areas of the fabric; and (ii) laundering the entire fabric from step (i) in a conventional aqueous laundering process.

9. A dry cleaning kit, comprising:

(a) multiple, single-use sheets containing a non-aqueous dry-cleaning composition;

(b) multiple, single-use sheets containing an aqueous dry-cleaning composition;

(c) a re-usable containment bag; and (d) optionally, a re-usable holding tray.

* * * * *